United States Patent [19]

Swain et al.

[11] Patent Number: 4,553,905

[45] Date of Patent: Nov. 19, 1985

[54] VARIABLE CAPACITY WOBBLE PLATE COMPRESSOR WITH HIGH STABILITY OF CAPACITY CONTROL

[75] Inventors: James C. Swain; David L. Thomas, both of Columbus, Ohio

[73] Assignee: Diesel Kiki Co., Ltd., Tokyo, Japan

[21] Appl. No.: 608,514

[22] Filed: May 9, 1984

[51] Int. Cl.[4] ..... F04B 1/28

[52] U.S. Cl. ..... 417/222; 417/270

[58] Field of Search ..... 417/270, 269, 222; 92/12.2

[56] References Cited

U.S. PATENT DOCUMENTS

| | | | |
|---|---|---|---|
| 3,861,829 | 1/1975 | Roberts | 417/276 |
| 4,061,443 | 12/1977 | Black | 92/12.2 |
| 4,077,269 | 3/1978 | Hodgkinson | 92/12.1 |
| 4,178,135 | 12/1979 | Roberts | 417/269 |
| 4,294,139 | 10/1981 | Bex | 92/12.2 |
| 4,428,718 | 1/1984 | Skinner | 417/470 |

*Primary Examiner*—William L. Freeh

*Attorney, Agent, or Firm*—Charles S. McGuire

[57] ABSTRACT

A wobble plate compressor which is adapted to vary the angularity of the wobble plate during rotation in response to the difference between the resultant reaction force exerted by the pistons on their compression and suction strokes and the pressure in the crankcase. The wobble plate is supported by a first fulcrum movable along the drive shaft around which it is disposed, at a diametrically central location, and by a second fulcrum at a location radially spaced from the drive shaft. The second fulcrum is formed by an end of an arm member disposed for rotation together with the drive shaft. The above end of the arm member is in camming engagement with a side surface of the wobble plate so that with an increase in the angularity of the wobble plate the second fulcrum moves toward the axis of the drive shaft through a substantial stroke, whereby the angularity of the wobble plate can vary at a reduced rate relative to a change in the pressure in the crankcase, thereby enhancing the stability of capacity control.

5 Claims, 8 Drawing Figures

VARIABLE CAPACITY WOBBLE PLATE COMPRESSOR WITH HIGH STABILITY OF CAPACITY CONTROL

BACKGROUND OF THE INVENTION

This invention relates to variable capacity wobble plate compressors mainly adapted for use in air conditioning systems for automotive vehicles, and more particularly to an improved wobble plate compressor in which the crankcase pressure is controllable for varying the displacement or capacity of the compressor.

A variable capacity wobble plate compressor in general is adapted to vary its displacement or capacity through a change in the angularity of the wobble plate. It is known e.g. from U.S. Pat. No. 3,861,829 to vary the refrigerant pressure in the crankcase for changing the angularity or angle of inclination of the wobble plate relative to the drive shaft. A conventional wobble plate compressor of this type comprises a fluidtight housing, a drive shaft rotatably disposed in the housing, a cylinder block arranged in the housing and formed therein with a plurality of cylinders circumferentially arranged around the drive shaft and extending substantially parallel to the axis of the drive shaft, pistons received in the respective cylinders for reciprocating motions therein, and a wobble plate supported at its diametrically central portion by trunnion pins extending at right angles to the drive shaft and axially movable therealong and also supported at its peripheral edge by a pivot pin rotatable about the drive shaft together therewith. The wobble plate is adapted to be pivotally displaced in unison with axial movement of the trunnion pins along the drive shaft to have its angularity varied relative to the drive shaft. As the wobble plate rotates in a position inclined relative to the drive shaft, the pistons are reciprocatingly moved in their respective cylinders for pumping actions. In the compressor, the resultant reaction force exerted by all the pistons, some on their compression strokes and some on their suction strokes, acts upon the wobble plate at a point inside a half portion of the circumference described by the axes of the cylinders, which is located at the same side of the drive shaft as the pistons on their compression strokes, so that the wobble plate is acted upon by the above resultant reaction force to become inclined relative to the drive shaft about the trunnion pins as a movable fulcrum during the pumping actions of the pistons. The resultant reaction force of the pistons counteracts the pressure in the crankcase which acts upon the pistons as back pressure. Therefore, when there occurs a drop in the pressure in the crankcase, the wobble plate is displaced in the angularity-increasing direction to increase the capacity, whilst when there occurs an increase in the crankcase pressure, the wobble plate is displaced in the angularity-decreasing direction to decrease the capacity.

In this arrangement, it is known that the difference between values of the crankcase pressure corresponding, respectively, to the maximum angularity of the wobble plate and the minimum angularity thereof falls within a range from 5 to 10 percent of the difference between the suction pressure and the discharge pressure of the compressor. For example, if the compressor is operating in a condition wherein the discharge pressure is 14 kg/cm$^2$, and the suction pressure is 2.1 kg/cm$^2$, the crankcase pressure has to be controlled within a very small range from approximately 2.7 kg/cm$^2$ to approximately 3.3 kg/cm$^2$, with a small pressure difference of approximately 0.6 kg/cm$^2$. This means that the angularity of the wobble plate varies in high response to a change in the crankcase pressure. This requires precise control of the crankcase pressure, making it difficult to control the capacity in a stable manner.

OBJECT AND SUMMARY OF THE INVENTION

It is the object of the invention to provide a variable capacity wobble plate compressor in which the rate of change of the angularity of the wobble plate is small relative to a change in the crankcase pressure, thereby making it possible to achieve stable control of the capacity without requiring precise control of the crankcase pressure.

In a variable capacity wobble plate compressor according to the present invention, the wobble plate is supported at a central location thereof by a first fulcrum movable along the drive shaft around which the wobble plate is disposed, and at a location radially spaced from the drive shaft by a second fulcrum which is formed by one end of an arm member disposed for rotation together with the drive shaft and about the axis of the drive shaft.

Pistons engage the wobble plate for reciprocating motions in their respective cylinders as the wobble plate rotates. The wobble plate has its angle of axial inclination relative to the drive shaft variable about the above first fulcrum for varying displacement of the pistons, in response to the difference between resultant reaction force exerted by the pistons on compression and suction strokes and pressure in the crankcase acting upon the pistons as back pressure.

The above arm member is rotatable about the axis of the drive shaft, of which the above one end has its face disposed in contact with one side surface of the wobble plate. At least one of the one end face of the arm member and the one side surface of the wobble plate has a camming surface on which the second fulcrum is located. The cam profile and radial position of the camming surface are set such that the camming surface acts to cause displacement of the second fulcrum toward the axis of the drive shaft through a substantial stroke with an increase in the angularity of the wobble plate.

The above and other objects, features and advantages of the invention will be more apparent from the ensuing detailed description taken in conjunction with the accompanying drawings.

DETAILED DESCRIPTION

The invention will now be described in detail with reference to the drawings which show an embodiment of the invention.

Figure 1:
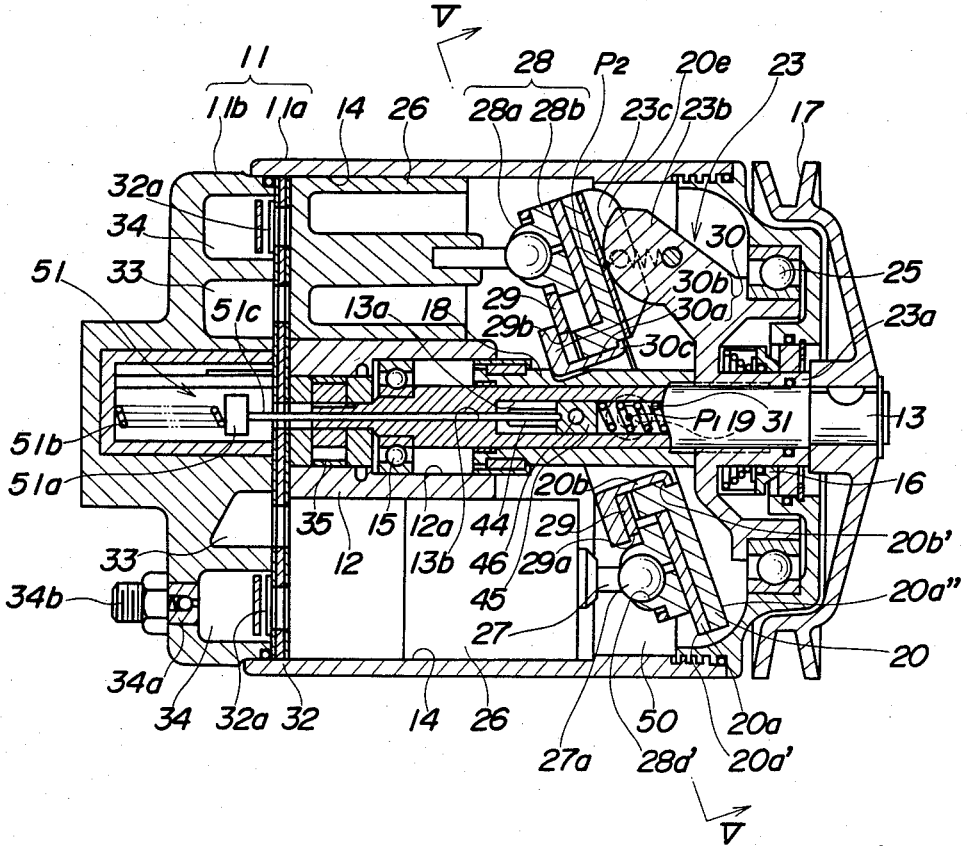
FIG. 1 is a horizontal longitudinal sectional view of a variable capacity wobble plate compressor according to an embodiment of the present invention.
Figure 2:
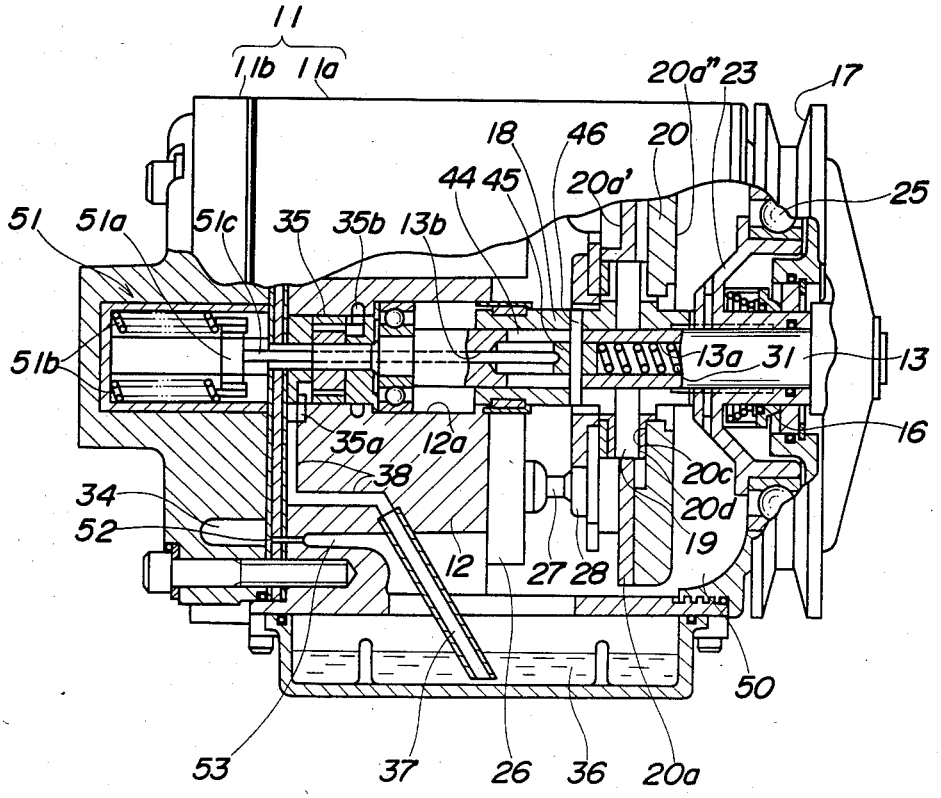
FIG. 2 is a vertical longitudinal sectional view of the same compressor.

Referring first to FIGS. 1 and 2, there is shown the whole construction of a variable capacity wobble plate compressor according to the invention. The compressor is described hereinbelow as applied to an air conditioning system for automotive vehicles. Reference numeral 11 designates a housing which is formed by a cylindrical casing 11*a* and a cylinder head 11*b* combined together. A cylinder block 12 is arranged within the cylindrical casing 11*a*, which is formed integrally with the casing 11*a* and formed therein with a plurality of cylinders 14 circumferentially arranged around a drive shaft 13 and extending substantially parallel to the axis of same. Pistons 26 are slidably received within respective ones of the cylinders 14. A crankcase 50 is defined in the housing 11 by an inner end of the cylinder block 12 and inner walls of the casing 11*a*. The drive shaft 13 is disposed substantially along the longitudinal axis of the housing 11, with its one end portion journalled by a ball bearing 15 mounted in a central bore 12*a* formed in the cylinder block 12. The other end portion of the drive shaft 13 extends through a boss 23*a* of an arm member 23 which has a radially obliquely extending arm 23*b*. The arm member 23 is journalled by a large-sized ball bearing 25 mounted in the casing 11*a*. Thus, the other end portion of the drive shaft 13 remote from the cylinder block 12 is supported by the casing 11*a* by means of the arm member 23 and the ball bearing 25. The same end portion of the drive shaft 13 further extends through a front end wall of the casing 11*a* on the right side as viewed in FIG. 1, with its tip exposed to the outside and carrying a pulley 17 rigidly fitted thereon. A sealing assembly 16 is fitted on the boss 23*a* of the arm member 23 to maintain airtightness between the boss 23*a* and the casing 11*a*. The pulley 17 is connected by a driving belt to the output shaft of an engine installed in a vehicle, none of which is shown.

Figure 3:
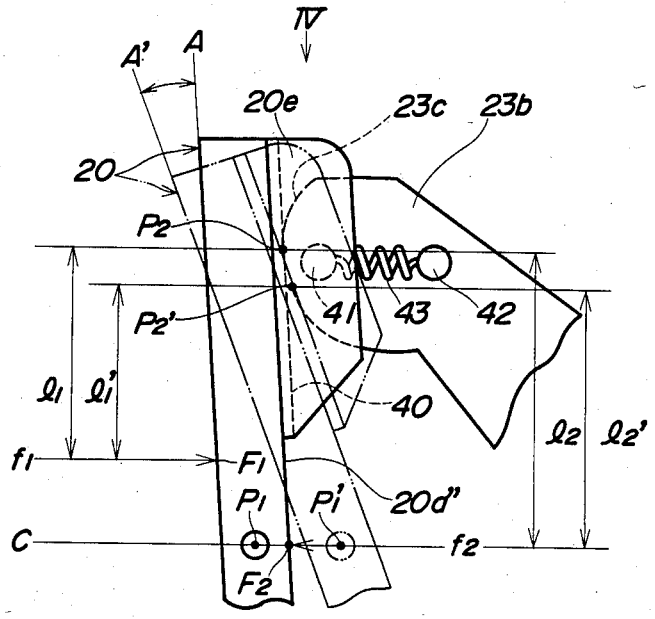
FIG. 3 is a schematic side view of the wobble plate and the second fulcrum forming essential part of the invention.
Figure 4:
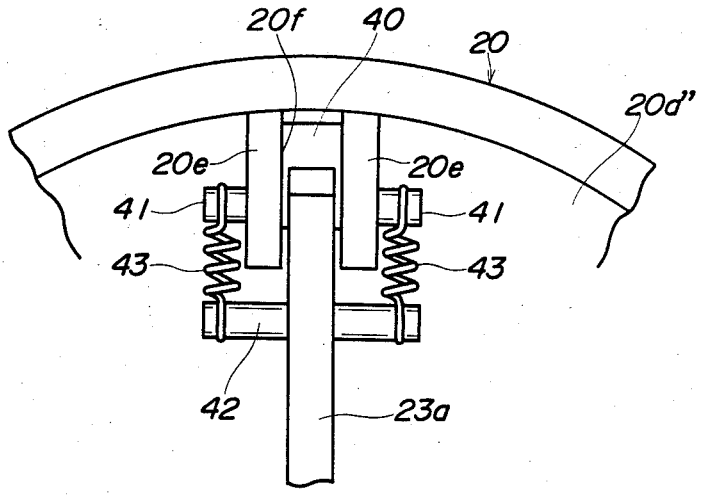
FIG. 4 is an end view as viewed in the direction of the arrow IV and FIG. 3.

A slider 18 in the form of a sleeve is fitted on an intermediate portion of the drive shaft 13 for axial sliding movement thereon, on which are secured a pair of trunnion pins 19 as a pivot extending at right angles to the drive shaft 13. A wobble plate 20 in the form of a disc is freely fitted on the slider 18 at its central through bore 20*b* and engages with the latter for pivoting about a first fulcrum or supporting point P1 formed by the trunnion pins 19 which are rotatably fitted, through collars 20*d*, in radial bores 20*c* formed in the inner peripheral wall of the central through bore 20*b* of the wobble plate 20. The arm 23*b* of the arm member 23 has a convex camming surface 23*c* having a generally semicircular cam profile, formed on its end face and disposed in contact with a side surface 20*a*″ of the wobble plate 20 remote from the cylinder block 12 at a predetermined location radially spaced from the drive shaft 13. The point of contact between the side surface 20*a*″ and the camming surface 23*c* forms a second fulcrum P2 for the wobble plate 20. Details of the fulcrum P2 and its peripheral parts are shown in FIGS. 3 and 4. The side surface 20*a*″ of the wobble plate 20 is formed thereon with a pair of guide protuberances 20*e* and 20*e* radially extending parallel with each other at predetermined locations and defining therebetween a gap 20*f* with a width nearly equal to the thickness 23*b* of the arm member 23, in which tip of the arm 23*b* is engaged. The gap 20*f* has its bottom surface coated with a wear resisting material 40, and the camming surface 23*c* is disposed in contact with the wear resisting material 40 to form the second fulcrum P2. Thus, as the first fulcrum P1 formed by the trunnion pins 19 axially moves along the drive shaft 13, the wobble plate 20 is tilted about the first fulcrum P1 in a manner having its axial inclination varied relative to a vertical line to thus vary the displacement of the pistons 26. At the same time, the second fulcrum P2 radially moves along the guide protuberances 20*e*, 20*e* while it is prohibited from circumferential displacement by them. The compressor is so arranged that at the minimum angle of inclination of the wobble plate 20, the pistons 26 are allowed to make reciprocating motions through a stroke length equal to several percent of the maximum stroke length.

The first and second fulcrums P1, P2 are so located that irrespective of the angle of inclination of the wobble plate, each of the pistons 26 always starts its suction stroke motion nearly at an extreme end position in the cylinder 14 forming the top dead center of the piston.

Further, as shown in FIG. 3, the cam profile and radial position of the camming surface 23*c* are so set that as the wobble plate 20 becomes tilted from a minimum angularity position A, the second fulcrum P2 is radially inwardly displaced toward the axis C of the drive shaft 13 with a large amount of displacement, and at a maximum angularity position A′ of the wobble plate 20, the fulcrum P2 assumes a position P2′ closest to the axis C, and that the displacement P2 - P2′ of the fulcrum P2 corresponding to tilting of the wobble plate 20 between the minimum and maximum angularity positions A, A′ is far larger than that of a conventional compressor of this kind.

A pair of pins 41 and 41 are fitted in opposite outer side surfaces of the parallel guide protuberances 20*e*, 20*e* and extend in opposite lateral directions with their axes aligned with each other, while a pin 42 is transversely fitted at its central portion through the arm 23*b* at a side of the pins 41, 41 remote from the wobble plate 20 and spaced from the same pins. Coiled springs 43 and 43 are connected between respective pairs of pins 41, 42 to maintain the side surface 20*a*″ of the wobble plate 20 in urging contact with the camming surface 23*c* of the arm 23*b* and thereby obtain positive engagement between the two members.

The camming engagement between the wobble plate 20 and the arm member 23 for causing displacement of the second fulcrum P2 relative to the axis C of the drive shaft 13 in response to a change in the angularity of the wobble plate 20 is not limited to the combination of a flat surface on the wobble plate 20 and a convex surface on the arm 23*b* as in the present embodiment. Any other combination of engaging surfaces with various profiles may be employed insofar as it can perform a camming function equivalent to the camming function of the present embodiment, for example, a combination of a convex surface on the wobble plate and a flat surface on the arm member, a combination of a concave surface on the wobble plate or the arm member and a convex surface on the other, etc.

The urging means or coiled springs 43, 43 for maintaining the side surface 20*a*′ of the wobble plate 20 and the camming surface 23c of the arm 23b in tight contact with each other may be omitted, if required, since the resultant reaction force exerted by the pistons 26 on compression strokes acts upon the wobble plate 20 in the direction of the camming surface 23c, which serves to obtain a similar engaging function to the above, during operation of the compressor.

The drive shaft 13 is formed therein along its axis with an axial hole 13a with a larger diameter extending in a portion of the drive shaft remote from the cylinder block 12 and another axial hole 13b with a smaller diameter extending continuously from an end of the axial hole 13a toward the cylinder block 12 and opening in a corresponding end face of the drive shaft 13. The drive shaft 13 has its peripheral wall formed therein with a pair of axially elongate slots 44 and 44 at diametrically opposite locations. An internal slider 45 is slidably fitted in the large-sized axial hole 13a and urged toward the cylinder block 12 by a coiled spring 31 disposed in the same hole. A cross pin 46 is diametrically penetrated through the internal slider 45, with its opposite ends radially extending through the respective associated slots 44, 44 and fitted through the inner peripheral wall of the external slider 18 slidably fitted on the drive shaft 13. Thus, the slider 18 is permanently urged toward the cylinder block 12 together with the internal slider 45 which is urged toward the cylinder block 12 by the coiled spring 31 as noted above, thereby permanently urging the wobble plate 20 in the angularity-decreasing direction.

Figure 5:
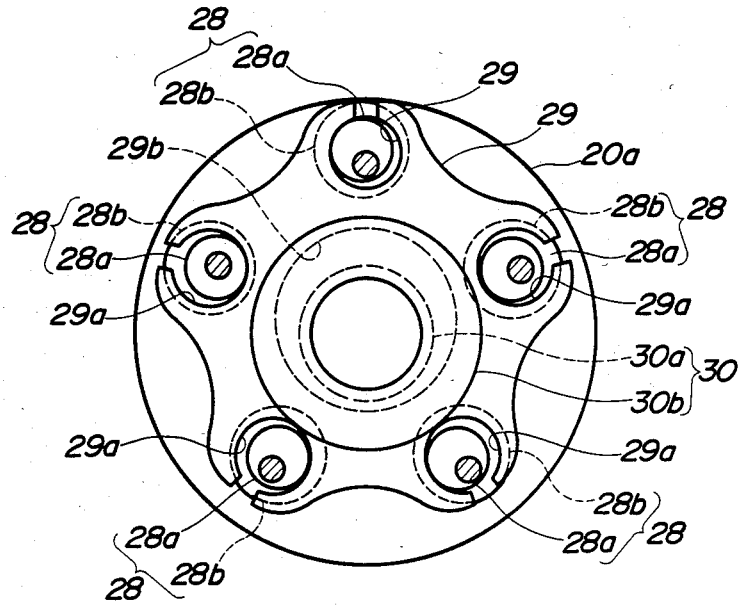
FIG. 5 is an end view taken along line V—V in FIG. 1.

On the other hand, the pistons 26 slidably received within the respective cylinders 14 formed in the cylinder block 12 are each provided with a piston rod extending along its axis toward the wobble plate 20 and integrally formed at its tip with a sphere 27a. The spheres 27a spherically engage in spherical holes 28a' formed in respective slipper shoes 28 each composed of a trunk portion 28a and a flanged portion 28b formed integrally with each other. The slipper shoes 28 are held in slidable contact or close proximity with the sliding side surface 20a' of the rockingly rotating wobble plate 20 by means of a first retainer member 29, which is freely movable per se and engages the slipper shoes 28 for movement together therewith, as well as a second retainer member 30 which holds the first retainer member 29 in slidable contact or close proximity with the slipper shoes. More specifically, as best shown in FIG. 5, the first retainer member 29 is formed therein with five through bores 29a circumferentially arranged in the vicinity of its outer peripheral edge at locations corresponding to respective ones of the slipper shoes 28, each through bore 29a being slightly larger in diameter than the trunk portion 28a of its associated slipper shoe 28. The illustrated compressor is a five cylinder type. The first retainer member 29 is also formed therein with a central through bore 29b considerably larger in diameter than the drive shaft 13 and loosely fitted on the latter. The slipper shoes 28 have their trunk portions 28a loosely fitted in their respective through bores 29a of the first retainer member 29 and their flanged portions 28b disposed in slidable contact or close proximity with the same member 29, respectively, in such a manner that as the slipper shoes 28 slidingly move on the wobble plate, the first retainer member 29 is freely moved in directions substantially parallel to the sliding side surfaces of the wobble plate 20. The second retainer member 30 comprises an axially extending hollow tubular portion 30a loosely fitted in the central through bore 29b of the first retainer member 29 and also unremovably fitted in the central through bore 20b of the wobble plate 20 with its radially outwardly deformed hook 30c engaged by a stepped shoulder 20b' formed on the central through bore 20b of the wobble plate 20, and a radially flanged portion 30b formed integrally on an end of the hollow tubular portion 30a and larger in diameter than the central through bore 29b of the first retainer member 29 but so small in diameter that it does not interfere with movement of the associated slipper shoes 28 on the wobble plate 20. The second retainer member 30 has its flanged portion 30b disposed to hold the first retainer member 29 in slidable contact or close proximity with the slipper shoes 28 while allowing an inner portion of the first retainer member 29 around its central bore to slide on the flanged portion 30b.

The side surface of the wobble plate 20 facing the pistons 26 is formed by a separately fabricated disc member 20a formed of a wear resisting material which is positioned radially by the hub 20b and prevented from rotation relative to the wobble plate 20 by mechanical means not shown, such as two diametrically opposite flat surfaces on the outer diameter of the hub 20b and two mating chordal surfaces formed in the through bore of the disc member 20a.

A valve plate 32 is disposed along an outer end face of the cylinder block 12, which carries thereon suction valves, not shown, and discharge valves 32a at locations corresponding to their respective cylinders 14. The suction valves are arranged between the cylinder bores and an annular suction chamber 33 formed in the cylinder head 11b, and the discharge valves 32a between the cylinder bores and an annular discharge chamber 34 formed in the same head 11b, respectively. The discharge chamber 34 is provided with a check valve 34a at its outlet, which is opened when the pressure in the chamber 34 exceeds a predetermined value, and the chamber 34 can communicate through the opened valve 34a with an outlet port formed in a discharge connector 34b which is to be connected to the refrigerating circuit, not shown, of the air conditioner.

An oil pump 35 for feeding lubricating oil to various sliding parts of the compressor is arranged in the cylinder block 12 at an extension of the axis of the drive shaft 13 and coupled to the rear end of the drive shaft 13 to be rotatively driven by the latter. The suction port 35a of the oil pump 35 is communicated with an oil sump 36 arranged at the bottom of the casing 11a through an oil passage 38 formed in the cylinder block 12 and an oil pipe 37 connected thereto, while the discharge port 35b of the oil pump 35 is connected to an oil passage, not shown, formed in the cylinder block 12 to feed lubricating oil to the sliding parts of the compressor.

A potentiometer 51, which forms sensor means for sensing the angularity of the wobble plate 20, is arranged in the cylinder head 11b at an extension of the axis of the drive shaft 13, and comprises a slider 51a urged toward the drive shaft 13 by springs 51b to be held in urging contact with the internal slider 45 through a rod 51c freely and axially slidably fitted through the small-sized axial hole 13b in the drive shaft 13. Thus, the slider 51a of the potentiometer 51 follows axial displacement of the internal slider 45.

Figure 6:
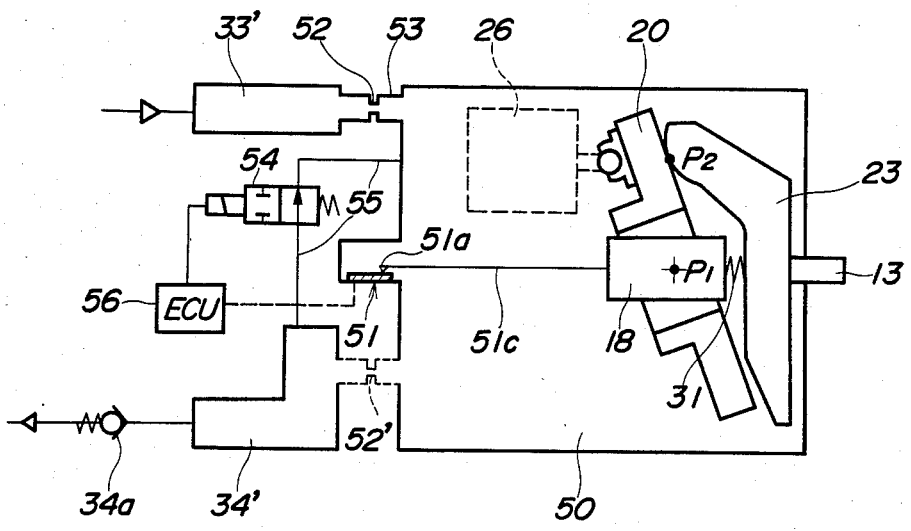
FIG. 6 is a block diagram of an example of the arrangement of a control system for the compressor.

FIG. 6 shows an example of the control system for controlling the compressor according to the invention. The interior of the crankcase 50 is communicated with a space 33' under a low pressure (e.g. the suction chamber 33) by way of a passage 53 with an orifice 52 formed therein. The cross-sectional area of the orifice 52 is set at such a value as to permit blow-by gas leaked from the gaps between the cylinders 14 and the pistons 26 on compression strokes into the crankcase 50 to escape into the low pressure space 33' at such a flow rate as to permanently keep the internal pressure of the crankcase 50 below a maximum allowable value under all operating conditions of the compressor. In FIG. 6, the flow passage of the blow-by gas is shown in the form of an orifice 52'. The interior of the crankcase 50 is communicated with a space 34' under a higher pressure (e.g. the discharge chamber 34) by way of a passage 55 with a solenoid-operated control valve 54 disposed therein. The output of the potentiometer 51 is connected to the input of an electronic control unit 56 which in turn has its output connected to the solenoid of the control valve 54.

The operation of the compressor according to the invention constructed as above will now be described. When the electronic control unit 56 is not providing electric power to the solenoid-operated control valve 54 to keep same opened, the interior of the crankcase 50 is communicated via the opened valve 54 with the high pressure space 34' through the passage 55. If on this occasion the compressor is at rest, the internal slider 18 is biased in the leftward position as viewed in FIG. 6 by the force of the coiled spring 31, and accordingly the wobble plate 20 is held in the minimum angularity position. If on this occasion the pulley 17 is rotated by the engine, not shown, the rotation is transmitted to the drive shaft 13 to cause rotation of the arm member 23 in unison with the drive shaft 13. The rotating arm member 23 causes rotation of the wobble plate 20 through the mutually engaging arm **23*a* and guide protuberances 20*e*, 20*e* on the wobble plate 20. As noted above, the rotating wobble plate 20 in its minimum angularity position causes the pistons to make reciprocating motions through a stroke length equal to several percent of the maximum stroke length. The stroking motions of the pistons causes a drop in the pressure in the lower pressure space 33', and simultaneously an increase in the pressure in the higher pressure space 34'. The pressure drop in the lower pressure space 33' is transmitted to the crankcase 50 through the orifice 52, while the pressure increase in the high pressure space 34' is also transmitted to the crankcase through the opened passage 55, so that the pressure in the crankcase 50 does not drop and acts upon the wobble plate 20 in the direction of the pistons 26. As shown in FIG. 3, on this occasion, the moment of the resultant force f2 of back pressures acting upon the pistons 26 or internal pressure in the crankcase 50 is balanced with the counteracting moment of the resultant reaction force f1 exerted by the pistons 26 and acting upon the wobble plate 20 in the direction away from the pistons, so that the wobble plate 20 is maintained in its minimum angularity position by the force of the spring 31**, whereby the compressor is idling.

On the other hand, when the electronic control unit 56 is providing electric power, the solenoid-operated control valve 54 is closed to interrupt the communication between the interior of the crankcase 50 and the higher pressure space 34'. Then, a drop in the pressure in the lower pressure space 33' caused by stroke motions of the pistons 26 alone is transmitted through the orifice 52 into the crankcase 50 to cause a drop in the pressure in the crankcase 50, while simultaneously the pressure in the higher pressure space 34' increases, so that the moment of the resultant force f2 of back pressures acting upon the pistons 26 or internal pressure in the crankcase 50 drops below the moment of the resultant reaction force f1 to increase the angularity of the wobble plate 20 and accordingly increase the stroke length of the pistons 26, thereby increasing the capacity of the compressor. The check valve **34*a* aids startup by creating a small differential pressure which causes sufficient pressure increase in the higher pressure space 34' so that the wobble plate is moved significantly in the angularity increasing direction before the check valve 34*a* opens and allows flow from the compressor to the air conditioning system. The change of the angularity of the wobble plate 20 is transmitted to the slider 51*a* of the potentiometer 51 through the internal slider 45 axially moving in the axial hole 13*a* of the drive shaft 13 in response to the change of the angularity and the rod 51*c* moving together with the slider 45. An output signal from the potentiometer 51 indicative of the angularity of the wobble plate 20 is supplied to the electronic control unit 56 which in turn operates on the output signal from the potentiometer 51 and other parameters such as heat load on the air conditioner and the rotational speed of the engine to generate a control signal and supply same to the solenoid-operated control valve 54. More specifically, the electronic control unit 56 determines from the angularity of the wobble plate 20 indicated by the potentiometer 51 whether or not the capacity of the compressor corresponding to the angularity has reached a required value, and when the former has reached the latter, it causes the control valve 54 to be opened. Then, the interior of the crankcase 50 is communicated through the passage 55 with the higher pressure space 34' so that the high pressure in the higher pressure space 34' is introduced into the crankcase 50 to interrupt the decrease of the pressure in the crankcase 50 to thereby interrupt the increase of the angularity of the wobble plate 20. The introduction of the high pressure into the crankcase 50 causes an increase in the crankcase pressure, which causes a decrease in the angularity of the wobble plate 20. This angularity decrease is sensed by the potentiometer 51, and accordingly the electronic control unit 56 causes the control valve 54 to be closed to interrupt the communication between the interior of the crankcase 50 and the higher pressure space 34'. Consequently, the crankcase pressure only undergoes leakage through the orifice 52 into the lower pressure space 33' to decrease so that the angularity of the wobble plate 20** is increased. The above operation is repeated to control the capacity of the compressor to values corresponding to heat load on the air conditioner.

If the capacity of the compressor rises above or drops below a value required for the head load on the air conditioner due to an increase or a decrease in the rotational speed of the engine, or due to a decrease or an increase in the heat load, the electronic control unit 56 operates to open or close the control valve 54 for control of the angularity of the wobble plate or the capacity of the compressor. That is, when the capacity of the compressor increases above a value required for the heat load on the air conditioner, the crankcase pressure is increased to decrease the angularity of the wobble plate 20, whereas when the compressor capacity decreases below such a value, the crankcase pressure is decreased to increase the angularity of the wobble plate.

During the above operation, with an increase in the angularity of the wobble plate 20, the second fulcrum P2 formed by the engaging surfaces of the wobble plate 20 and the arm 23*b* of the arm member 23 is displaced in the direction of the axis C of the drive shaft. Consequently, the moment of the resultant force f2 (the resultant force of back pressures upon the pistons 26 or internal pressure in the crankcase 20, which acts upon the wobble plate 20 in the direction of the pistons 26) and the moment of the resultant force f1 (the resultant reaction force exerted by the pistons 26 on compression and suction strokes and acting upon the wobble plate 20 in the direction away from the pistons 26) with respect to the second fulcrum P2 decrease as the angularity of the wobble plate 20 increases. More specifically, the following relationships of $f1 \times l1 > f1 \times l'1$ and $f2 \times l2 > f2 \times l'2$ stand, where l1 and l'1 designate, respectively, the distance between the location P2 of the second fulcrum assumed with the wobble plate in its minimum angularity position A and the point of application F1 of the resultant force f1 to the wobble plate, and the distance between the location P2' of the second fulcrum assumed with the wobble plate in its maximum angularity position A' and the point of application F1 of the resultant force f1; and l2 and l'2 designate, respectively, the distance between the location P2 and the point of application F2 of the resultant force f2 to the wobble plate, and the distance between the location P2' and the point of application F2 of the resultant force f2.

Assuming now that in a conventional compressor of this type, l1 is equal to 25 mm, and l2 to 35 mm, respectively, and the displacement of the second fulcrum P2 toward the axis of the drive shaft 13 with an increase in the angularity of the wobble plate 20 is equal to 2 mm, l'1 is equal to 23 mm, and l'2 to 33 mm, respectively. The crankcase pressure would be proportional to the ratio of moments of f1 and f2 as follows: $l1/l2=25/35=0.714$ and $l'1/l'2=23/33=0.697$.

On the other hand, according to the compressor of the present invention, assuming that the displacement of the second P2 is equal to 10 mm, l'1 is equal to 15 mm, and l'2 to 25 mm, respectively. So the crankcase pressure would be proportional to the ratio of moments of f1 and f2 as follows: $l1/l2=25/35=0.714$ and $l'1/l'2=15/25=0.600$.

As shown by the above example, lower crankcase pressure is required with an increase in the angularity of the wobble plate. However, according to the present invention there is a greater change in crankcase pressure for the same change in wobble plate angle. Thus stable operation is more easily achieved with the present invention.

Figure 7:
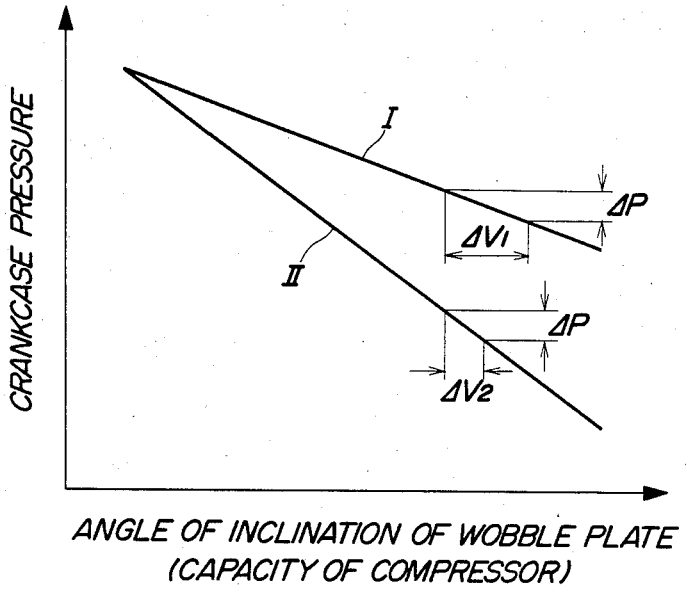
FIG. 7 is a graph showing the relationship between the crankcase pressure and the angle of inclination of the wobble plate, for comparison between a conventional compressor of this type and the compressor according to the present invention.

FIG. 7 shows the relationship between the internal pressure in the crankcase and the angularity of the wobble plate (the capacity of the compressor) according to the invention, given in comparison with that of a conventional compressor of this type. In the graph of FIG. 7, the line I shows the crankcase pressure characteristic of the conventional compressor with an ordinary amount of displacement of the second fulcrum relative to a change in the angularity of the wobble plate, and the line II the same characteristic of a compressor according to the present invention with a larger amount of displacement of the second fulcrum than that of the conventional compressor, respectively. It will be noted from the graph that according to the line II, the angularity of the wobble plate or the capacity of the compressor has a smaller change relative to a change P in the crankcase pressure than according to the line I. Therefore, according to the present invention, the capacity can be controlled in a stable manner with ease, even without precise control of the crankcase pressure.

Further, according to the invention, under all operating conditions of the compressor, blow-by gas leaked into the crankcase 50 through gaps between the cylinders 14 and the pistons 26 is permanently allowed to flow into the lower pressure space 33' through the orifice 52 which has a sufficient cross-sectional area during operation of the compressor such that if the control valve 54 is closed, the crankcase pressure will always decrease. Therefore, the control of the crankcase pressure can be achieved merely by controlling the solenoid-operated control valve 54 alone to thereby control the communication between the high pressure space 34' and the crankcase 50.

Now, if it is desired to apply all the output from the engine to driving of the vehicle at acceleration of the vehicle, running of the vehicle on an ascent, etc., the electronic control unit 56 stops providing electric power so that the control valve 54 is opened to promptly introduce the higher pressure in the higher pressure space 34' into the crankcase 50 through the passage 55. Then, the crankcase pressure is instantly elevated to cause prompt displacement of the wobble plate 20 to its minimum angularity position, whereby the compressor comes into an idling state. As a consequence, part of the engine output normally consumed by the compressor is also applied to driving of the vehicle to thereby enhance the accelerability of the vehicle, the ability of same to run up an ascent, etc.

Moreover, as noted before, the positions of the first and second fulcrums P1, P2 are set such that the pistons 26 start their stroke or reciprocating motions from their extreme end or top dead center positions in their respective cylinders 14, irrespective of the angularity of the wobble plate then assumed. This means that the clearance volume of each cylinder is very small even when the wobble plate assumes a very small angularity and accordingly the capacity of the compressor is very small, thereby always ensuring sufficient compression efficiency.

Figure 8:
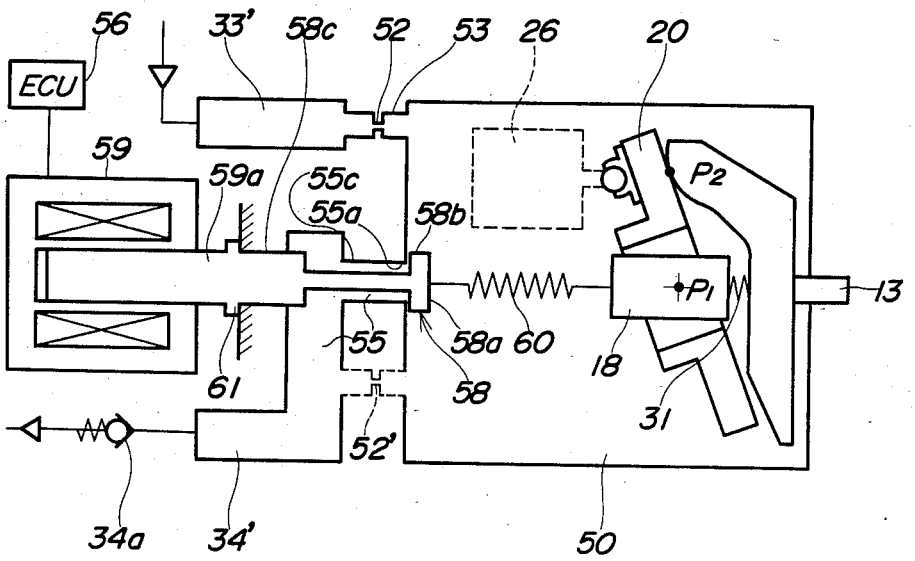
FIG. 8 is a block diagram of another example of the arrangement of the control system for the compressor according to the present invention.

FIG. 8 shows another example of the control system for the compressor according to the invention. This control system is an internal feedback type, as distinct from the control system of the previous embodiment which is an external feedback type. In FIG. 8, corresponding elements to those in FIG. 6 are designated by identical reference numerals and symbols. According to the present embodiment, a solenoid-operated control valve 58 is arranged at an end 55*a* of the passage 55 opening in the crankcase 50 to selectively close and open same. The control valve 58 has its valve poppet 58*a* coupled to a movable core 59*a* movable axially with the valve poppet 58*a* and relative to a solenoid 59. The valve poppet 58*a* is pulled in its opening direction by a feedback spring 60 which is coupled at an end to the slider 18 of the compressor 18. Stopper means 61 sets a maximum value of the valve opening of the control valve 58. An electronic control unit (ECU) 56 is connected to the solenoid 59 so that the latter is energized or deenergized in response to an output control signal from the former. The electronic control unit 56 is connected with the power switch, not shown, of the air conditioner for operation in response to closing and opening thereof, such that the solenoid 59 is kept energized all the time during operation of the air conditioner. During operation of the air conditioner, the control valve 58 opens and closes in response to changes in the pulling force of the feedback spring 60 or to changes in the solenoid current which is controlled by the electronic control unit 56. It is intended that the valve 58 will only assume either an open position or a closed position and will not assume an intermediate position.

According to the present control system arranged above, when the electronic control unit 56 is not providing electric power so that the solenoid 59 is in a deenergized state, the control valve 58 is biased in its maximum valve opening position. In this position, if the compressor is driven by the engine, discharge gas produced by small stroke motions of the pistons 26 and delivered into the higher pressure space 34' is introduced into the crankcase 50 to keep the crankcase pressure from decreasing so that the wobble plate 20 assumes its minimum angularity position to keep the compressor in an idling state. Then, if the electronic control unit 56 energizes the solenoid 59, e.g. when the power switch 57 of the air conditioner is closed, the valve poppet **58*a* of the control valve 58 is displaced to its closed position against the force of the feedback spring 60. Accordingly, the communication between the crankcase 50 and the higher pressure space 34' is interrupted, while simultaneously there occurs a drop in the lower pressure space 33' with small stroke motions of the pistons 26. This pressure drop is transmitted through the orifice 52 into the crankcase 50 to cause a drop in the crankcase pressure. At the same time, there occurs an increase in the pressure of the higher pressure space 34' with stroke motions of the pistons 26, thereby causing a gradual increase in the angularity of the wobble plate 20. The check valve 34*a* aids startup by creating a small differential pressure which causes sufficient pressure increase in the higher pressure space 34** so that the wobble plate is moved significantly in the angularity increasing direction before the check valve opens and allows flow from the compressor to the air conditioning system.

With this increase of the angularity of the wobble plate 20, the slider 18 is displaced in the direction of the feedback spring 60 being expanded. The resulting increased pulling force of the feedback spring 60 causes the valve 58 to open to allow compressed gas to flow from the high pressure space 34' into the crankcase 50. Consequently, the crankcase pressure increases to cause a decrease in the angularity of the wobble plate 20. This in turn causes the pulling force of the spring 60 to decrease sufficiently to allow the valve 58 to close, thereby causing a decrease in the crankcase pressure. In this manner, the wobble plate 20 assumes a value of angularity corresponding to the crankcase pressure thus controlled, and the compressor operates with a capacity corresponding to the angularity assumed by the wobble plate 20.

The control of the compressor capacity can be performed in a continuous manner responsive to changes in the rotational speed of the engine, the heat load on the air conditioner, etc. by varying the degree of energization of the solenoid 59, that is, the electric current value applied to the solenoid 59 by the electronic control unit 56. If it is desired to apply all the engine output to driving of the vehicle, the electronic control unit 56 interrupts the supply of electric current to the solenoid. Then, in the same manner as in the previous embodiment, the higher pressure in the higher pressure space 34' is promptly introduced into the crankcase 50 through the passage 55 to cause a prompt rise in the crankcase pressure and accordingly prompt displacement of the wobble plate 20 to its minimum angularity position, whereby the compressor comes into an idling state to allow application of part of the engine output to be consumed by the compressor to driving of the vehicle.

The above described embodiment of FIG. 8 has the advantage that the poppet-type solenoid valve 58 has a very short stroke to utilize the high solenoid forces that are developed at near the fully pulled-in position, so a small relatively low-cost solenoid can be used.

As described above, the wobble plate compressor according to the invention is constructed such that the second fulcrum for the wobble plate is displaced toward the drive shaft with an increase of the angularity of the wobble plate through a larger stroke than a conventional compressor of this type, to provide a smaller rate of change of the angularity of the wobble plate, i.e. capacity of the compressor relative to a change in the crankcase pressure, thereby enabling to achieve stable control of the capacity of the compressor even without precise control of the crankcase pressure.

Further, according to the invention, the control of the angularity of the wobble plate or the capacity of the compressor is effected by introducing high pressure from a higher pressure space into the crankcase of which the pressure continuously leaks into a lower pressure space. Therefore, the crankcase pressure can be promptly increased to obtain prompt cutting-off of the operation of the compressor, particularly, when it is desired to apply all the output from the engine to driving of the vehicle at acceleration of the vehicle, running of same on an ascent, etc.

Moreover, the introduction of high pressure into the crankcase is effected by a single valve means having a simple structure, facilitating the control of the compressor capacity and reducing the manufacturing cost.

While a preferred embodiment has been described, variations thereto will occur to those skilled in the art within the scope of the present inventive concepts which are delineated by the following claims.

What is claimed is:

1. A variable capacity wobble plate compressor comprising: a housing defining therein a crankcase, a lower pressure space, and a higher pressure space; a drive shaft rotatably disposed in said housing; a cylinder block arranged in said housing and defining therein a plurality of cylinders circumferentially arranged around said drive shaft and extending substantially parallel to the axis of said drive shaft, each of said cylinders having an interior thereof disposed for communication with said lower pressure space and said higher pressure space; pistons received in respective ones of said cylinders for reciprocating motions therein; a wobble plate arranged in said crankcase and pivotally and slidably fitted on said drive shaft for rotation together therewith, said pistons engaging said wobble plate for reciprocating motions in said respective ones of said cylinders as said wobble plate rotates; a pivot forming a first fulcrum supporting said wobble plate at a diametrically central location thereof and axially movable along said drive shaft; and an arm member rotatable together with said drive shaft about the axis of said drive shaft, said arm member having one end face disposed in contact with one side surface of said wobble plate to form a second fulcrum supporting said wobble plate at a location radially spaced from said drive shaft, whereby said second fulcrum is rotatable about the axis of said drive shaft together with said arm member; said wobble plate having an angle of axial inclination relative to said drive shaft variable between minimum and maximum values for varying displacement of said pistons in response to the difference between resultant reaction force exerted by said pistons on compression and suction strokes thereof and pressure in said crankcase acting upon said pistons as back pressure; at least one of said one side surface of said wobble plate and said one end face of said arm member having a camming surface on which said second fulcrum is located, said camming surface having a cam profile and said second fulcrum having a radial position such that said second fulcrum is moved toward the axis of said drive shaft through a substantial stroke with an increase in said angle of axial inclination of said wobble plate from said minimum to said maximum value.

2. A variable capacity wobble plate compressor as claimed in claim 1, wherein said camming surface comprises a convex surface formed in said one end face of said arm member, said one side surface of said wobble plate having a flat surface disposed in contact with said camming surface.

3. A variable capacity wobble plate compressor as claimed in claim 1, wherein said wobble plate has a pair of radially parallel guide protuberances formed on and extending outwardly from said one side surface thereof, said guide protuberances being spaced from one another to define a gap therebetween, said one end face of said arm member being disposed in said gap and maintained in direct, slidable, camming contact with said one side surface of said wobble plate, whereby said second fulcrum is radially displaceable relative to said wobble plate and parallel to said guide protuberances while being prohibited from circumferential displacement.

4. A variable capacity wobble plate compressor as claimed in claim 1, including elastic means arranged between said wobble plate and said arm member and urging said arm member to permanently keep said one end face thereof in urging contact with said one side surface of said wobble plate.

5. A variable capacity wobble plate compressor as claimed in claim 1, including a wear resisting material disposed over said camming surface.

* * * * *